US007497518B2

(12) United States Patent
Fritz et al.

(10) Patent No.: US 7,497,518 B2
(45) Date of Patent: Mar. 3, 2009

(54) BACKREST RECLINE MECHANISM FOR JUVENILE SEAT

(75) Inventors: Ward Fritz, Chelsea, MA (US); Richard M. Bastien, Cumberland, RI (US); John Ristuccia, Plainville, MA (US); Andrew W. Marsden, Hingham, MA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 11/873,996

(22) Filed: Oct. 17, 2007

(65) Prior Publication Data

US 2008/0088161 A1 Apr. 17, 2008

Related U.S. Application Data

(60) Provisional application No. 60/829,700, filed on Oct. 17, 2006.

(51) Int. Cl.
*A47B 83/02* (2006.01)
*A47D 1/10* (2006.01)

(52) U.S. Cl. ..... 297/354.12; 297/374; 297/148; 297/250.1; 297/256.1; 297/256.13

(58) Field of Classification Search ..... 297/354.12, 297/374, 148, 149, 150, 151, 152, 153, 154, 297/250.1, 256.1, 256.13
See application file for complete search history.

(56) References Cited

U.S. PATENT DOCUMENTS

| | | | | |
|---|---|---|---|---|
| 4,521,052 | A | 6/1985 | Cone | |
| 4,807,928 | A | 2/1989 | Cone | |
| 4,842,331 | A | 6/1989 | Waples | |
| 5,230,523 | A * | 7/1993 | Wilhelm | 297/250.1 X |
| 5,246,272 | A * | 9/1993 | Kato et al. | 297/354.12 X |
| 5,507,550 | A | 4/1996 | Maloney | |
| 5,558,400 | A * | 9/1996 | Poulson et al. | 297/153 X |
| 5,810,432 | A | 9/1998 | Haut et al. | |
| 5,823,615 | A | 10/1998 | Haut | |
| 5,951,102 | A | 9/1999 | Poulson et al. | |
| 6,050,643 | A | 4/2000 | Kain et al. | |
| 6,334,652 | B1 * | 1/2002 | Chen et al. | 297/357 X |
| 6,416,124 | B1 | 7/2002 | Chen et al. | |
| 6,419,312 | B1 | 7/2002 | Flannery et al. | |
| 6,666,505 | B2 * | 12/2003 | Greger et al. | 297/354.12 X |
| 6,679,552 | B1 * | 1/2004 | Kassai | 297/250.1 |
| 6,692,070 | B1 | 2/2004 | Hou et al. | |
| 7,008,018 | B2 * | 3/2006 | Chen | 297/363 |
| 7,066,542 | B2 * | 6/2006 | Wang | 297/376 |
| 7,100,988 | B1 * | 9/2006 | Hyslop | 297/376 |
| 7,219,959 | B2 * | 5/2007 | Ransil et al. | 297/354.12 X |
| 7,364,235 | B2 * | 4/2008 | Chen et al. | 297/354.12 X |
| 2005/0017549 | A1 * | 1/2005 | Chen | 297/153 X |
| 2005/0029852 | A1 * | 2/2005 | Chen | 297/354.12 |
| 2005/0127722 | A1 * | 6/2005 | Longenecker et al. | 297/148 |

* cited by examiner

*Primary Examiner*—Rodney B. White
(74) *Attorney, Agent, or Firm*—Barnes & Thornburg LLP

(57) ABSTRACT

A juvenile seat includes a seat base, a reclinable backrest, and a backrest lock. The backrest lock can be operated by a caregiver to allow for a change in the angular orientation of the reclinable backrest.

23 Claims, 5 Drawing Sheets

BACKREST RECLINE MECHANISM FOR JUVENILE SEAT

This application claims priority under 35 U.S.C. § 119(e) to U.S. Provisional Application Ser. No. 60/829,700, filed Oct. 17, 2006, which is expressly incorporated by reference herein.

BACKGROUND

The present disclosure relates to juvenile seats, and particularly to reclineable backrests in juvenile seats. More particularly, the present disclosure relates to an adjustment mechanism for changing the orientation of a backrest relative to a seat base in a juvenile seat.

SUMMARY

A juvenile seat in accordance with the present disclosure includes a seat base, a reclinable backrest, and a backrest lock including a movable backrest retainer. The backrest retainer is mounted for movement relative to the seat base to engage and disengage a retainer holder associated with the backrest to lock and unlock the backrest.

In illustrative embodiments, the backrest is mounted for pivotable movement relative to the seat base. The backrest can be moved among upright, first-reclined, and second-reclined positions.

In illustrative embodiments, a rotatable recline adjustor knob is included in the seat base and mounted for rotation about an axis to lock and unlock the backrest. The knob is coupled to the backrest retainer so that rotation of the knob in a first direction moves the backrest retainer away from the backrest to disengage the retainer holder and "unlock" the backrest. Rotation of the knob in an opposite second direction moves the backrest retainer toward the backrest to engage the retainer holder and "lock" the backrest.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
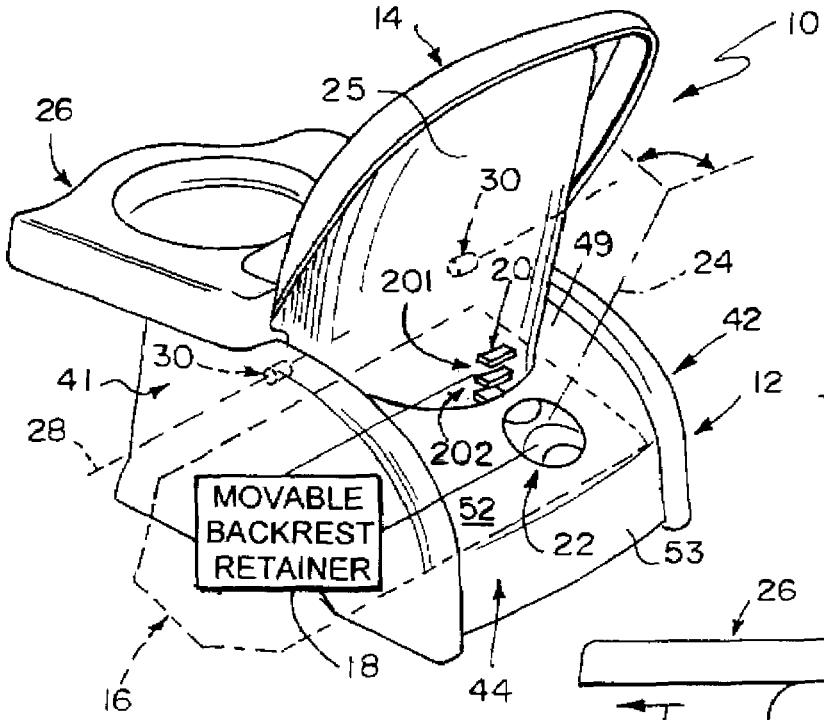
FIG. 1 is a rear perspective view of a juvenile booster seat including a backrest recline mechanism in accordance with the present disclosure, the juvenile booster seat comprising a seat base including a rotatable recline adjustor knob, a tray mounted on the seat base, and a backrest including several rearwardly facing anchor sockets provided to receive a backrest anchor included in a movable backrest retainer mounted for movement inside the seat base in response to rotation of the recline adjustor knob about an axis of rotation so that the backrest can be "locked" to the seat base and thus "retained" in, for example, any of the backrest orientations shown in FIGS. 2-4.

A juvenile booster seat 10 includes a seat base 12, a reclinable backrest 14, and a backrest lock 16 as suggested in FIG. 1. Reclinable backrest 14 is mounted for movement relative to seat base 12 to change the orientation of backrest 14 as suggested in FIGS. 2-4. Backrest lock 16 can be "released" as suggested in FIGS. 6 and 7 to allow such reclining movement of backrest 14 relative to seat base 12. When backrest lock 16 is "engaged," backrest 14 is locked so that it remains in one of several predetermined stationary positions shown, for example, in FIGS. 2-4.

Figure 5:
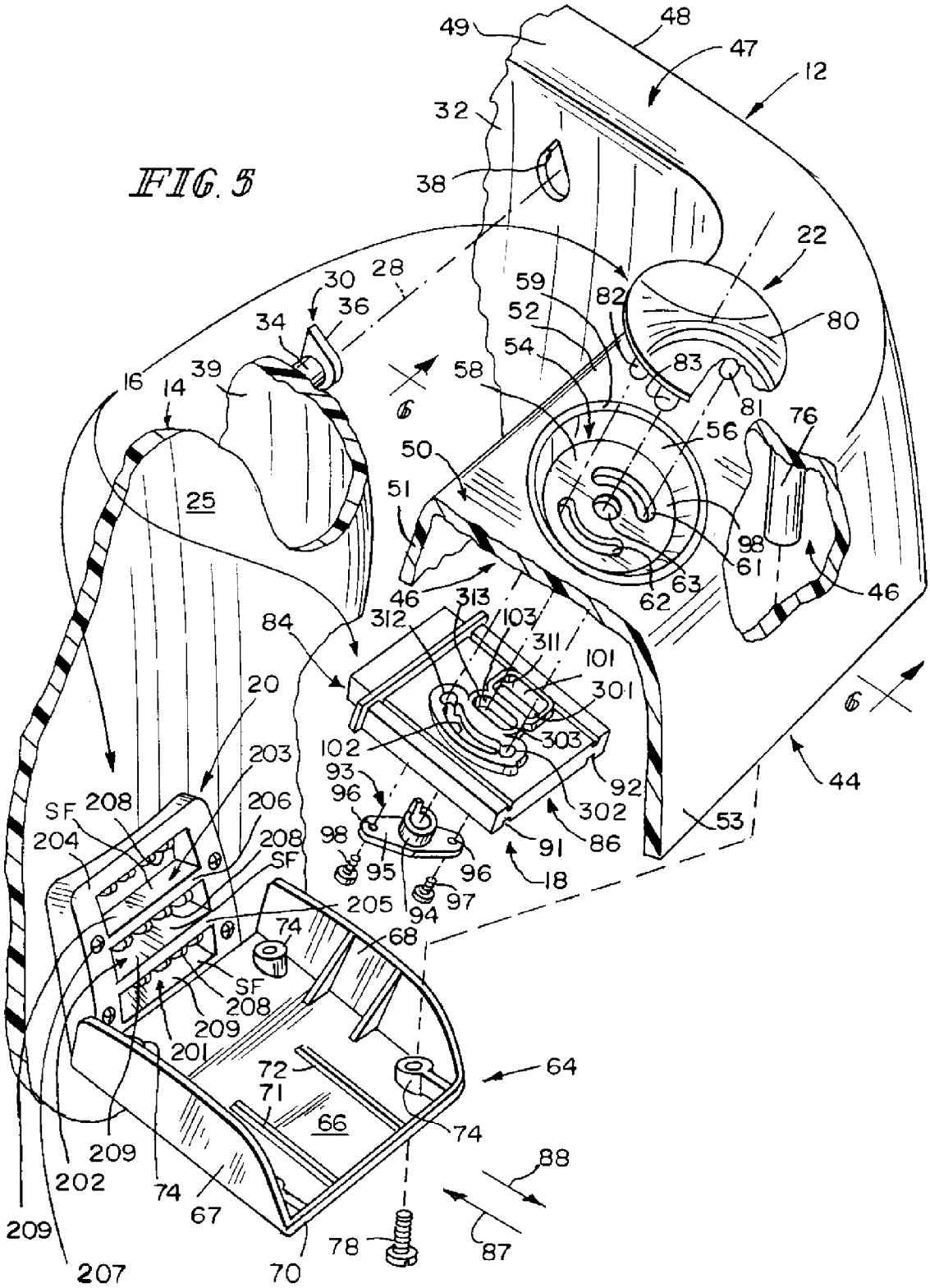
FIG. 5 is an enlarged exploded perspective view of a portion of the juvenile booster seat of FIGS. 1-4 showing the lower, middle, and upper anchor sockets provided in the backrest alongside a retainer mount lying under the anchor sockets and projecting inwardly toward a seat back included in the backrest, a round recline adjustor knob sized to be mounted for rotation in an upwardly opening knob receiver basin provided in the seat base and with a floor having a central aperture located between arcuate first and second channels, and a backrest retainer located below the round recline adjustor knob and above the retainer mount and provided with a backrest anchor sized to fit into each of the anchor sockets.

In an illustrative embodiment, backrest lock 16 comprises a movable backrest retainer 18 in seat base 12, a retainer holder 20 associated with backrest 14, and a recline adjustor 22 as suggested in FIGS. 1 and 5. Recline adjustor 22 is mounted for movement relative to seat base 12 to control motion of backrest retainer 18 toward and away from retainer holder 20 to cause engagement and release of backrest lock 16. In an illustrative embodiment, recline adjustor 22 is a "knob" that can be rotated about an axis of rotation 24 shown in FIG. 1 to move backrest retainer 18 toward a seat back 25 included in backrest 14 from an "unlocked" retracted position disengaging retainer holder 20 as suggested in FIGS. 6 and 7 to a "locked" extended position engaging retainer holder 20 as suggested in FIGS. 8 and 9.

It is within the scope of the present disclosure to use backrest lock 16 in any suitable seating environment. While backrest lock 16 is shown in juvenile booster seat 10 of the type used to seat a child in a "dining" environment, backrest lock 16 could also be used in a high chair, stroller, or other juvenile seat. In the illustrated embodiment, a feeding tray 26 is coupled to seat base 12 as suggested in FIGS. 1-4.

Figure 2:
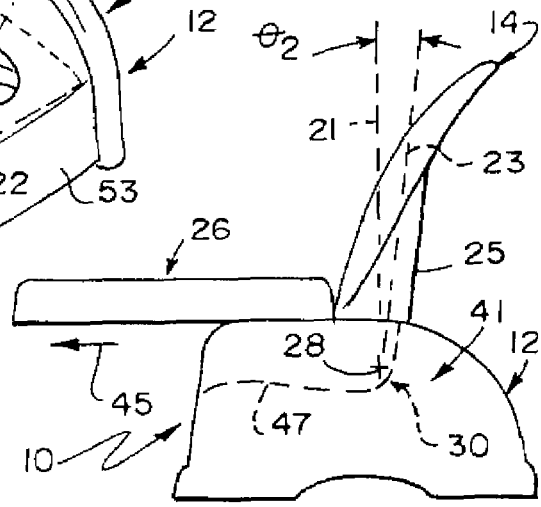
FIG. 2 is a side elevation view of the juvenile booster seat of FIG. 1 showing the backrest oriented to lie in an "upright" position associated with insertion of the backrest anchor included in the backrest retainer into a "lower" anchor socket provided in the backrest as suggested in FIGS. 8 and 9.
Figure 3:
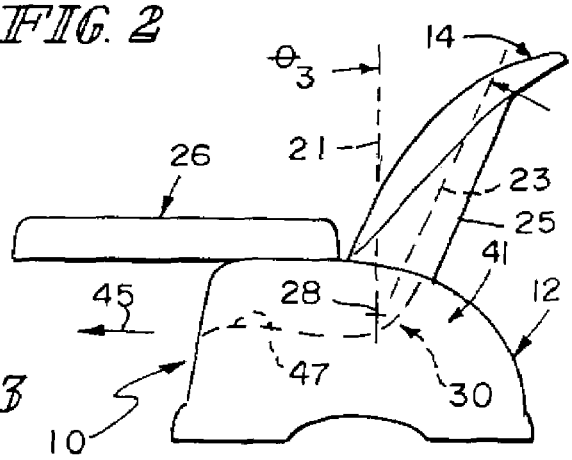
FIG. 3 is a side elevation view similar to FIG. 2 showing the backrest oriented to lie in a somewhat steep "first-recline" position associated with insertion of the backrest anchor into a "middle" anchor socket provided in the backrest.
Figure 4:
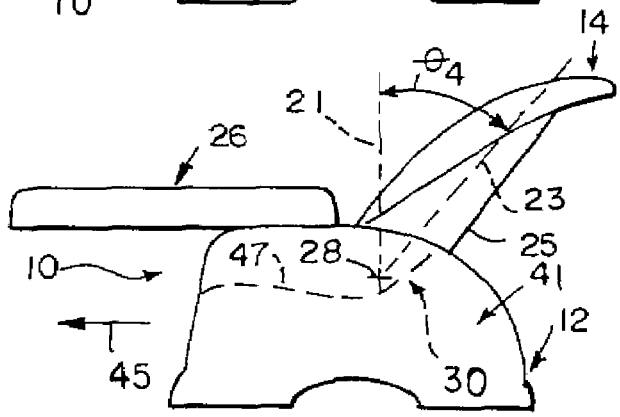
FIG. 4 is a side elevation view similar to FIGS. 2 and 3 showing the backrest oriented to lie in a more gently sloping "second-recline" position associated with insertion of the backrest anchor into an "upper" anchor socket provided in the backrest.

Backrest 14 is mounted for pivotable movement relative to seat base 12 about horizontal pivot axis 28 as suggested in FIGS. 2-5. This feature allows a user to change the orientation (i.e., angle of inclination with respect to a vertical plane) of backrest 14 relative to seat base 12. In an illustrative embodiment, reclineable backrest 14 is pivotable about pivot axis 28 (when unlocked) so that backrest 14 can be moved by a caregiver among an "upright" position shown in FIG. 2, a "first-recline" position shown in FIG. 3, and a "second-recline" position shown in FIG. 4. In an illustrative embodiment, the "orientation" angle $\theta_2$ in the upright position of FIG. 2 is about 7°, the orientation angle $\theta_3$ in the first-recline position of FIG. 3 is about 25°, and the orientation angle $\theta_4$ in the second-recline position of FIG. 4 is about 38°. In each case, the orientation angle is an included angle defined by vertical line 21 and a "moving" backrest line 23 associated with seat back 25 to describe the inclination of seat back 25 relative to the vertical.

Backrest 14 includes a pair of pivot mounts 30 used to support backrest 14 for pivotable movement relative to pivot axis 28 as suggested in FIGS. 1-4. Each pivot mount 30 is adapted to mate with a side interior wall 32 of seat base 12. One of those pivot mounts 30 is shown in FIG. 5 and formed to include a pivot rod 34 arranged to extend along pivot axis 28 and a teardrop-shaped rod anchor 36 coupled to a free end of pivot rod 34. Pivot rod 34 is appended to a side portion 39 of seat back 25 as suggested in FIG. 5. Rod anchor 36 is sized to pass through a "teardrop-shaped" anchor socket 38 formed in side interior wall 32 of seat base 12 to retain pivot rod 34 in a supported and pivotable position in anchor socket 38. It is within the scope of this disclosure to use any suitable system for supporting backrest 14 for reclining movement relative to seat 12.

In the illustrated embodiment, as shown in FIG. 1, seat base 12 includes first and second arm supports 41, 42 arranged to lie in spaced-apart relation to one another to locate backrest 14 therebetween. Seat base 12 also includes a rearwardly extending backrest support 44 located between first and second arm supports 41, 42. Seat base 12 also is formed to include a forwardly extending seat bottom 47. In an illustrative embodiment, seat bottom 47 extends in a forward direction 45 away from backrest 14 and underlies a portion of feeding tray 26 as suggested in FIGS. 2-4.

Figure 6:
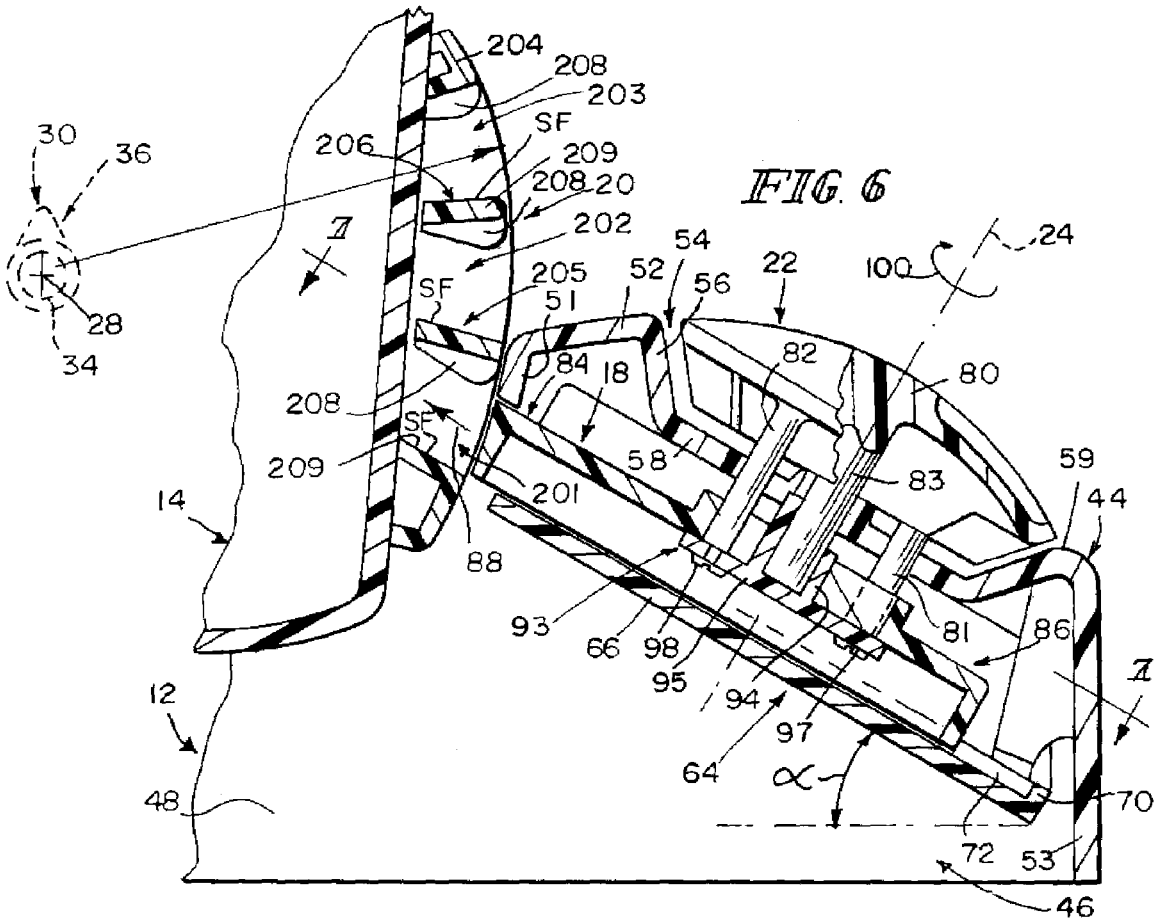
FIG. 6 is an enlarged sectional view taken along line 6-6 of FIG. 5 (after assembly of the components shown in FIG. 5) showing the backrest retainer in a "retracted" position in the retainer mount wherein the backrest anchor is withdrawn from the lower anchor socket so that a user of the juvenile booster seat is free to pivot the backrest about a pivot rod (shown in phantom) included in the backrest and mated to the seat base to assume any of the upright, first-recline, or second-recline positions shown in FIGS. 2-4.
Figure 8:
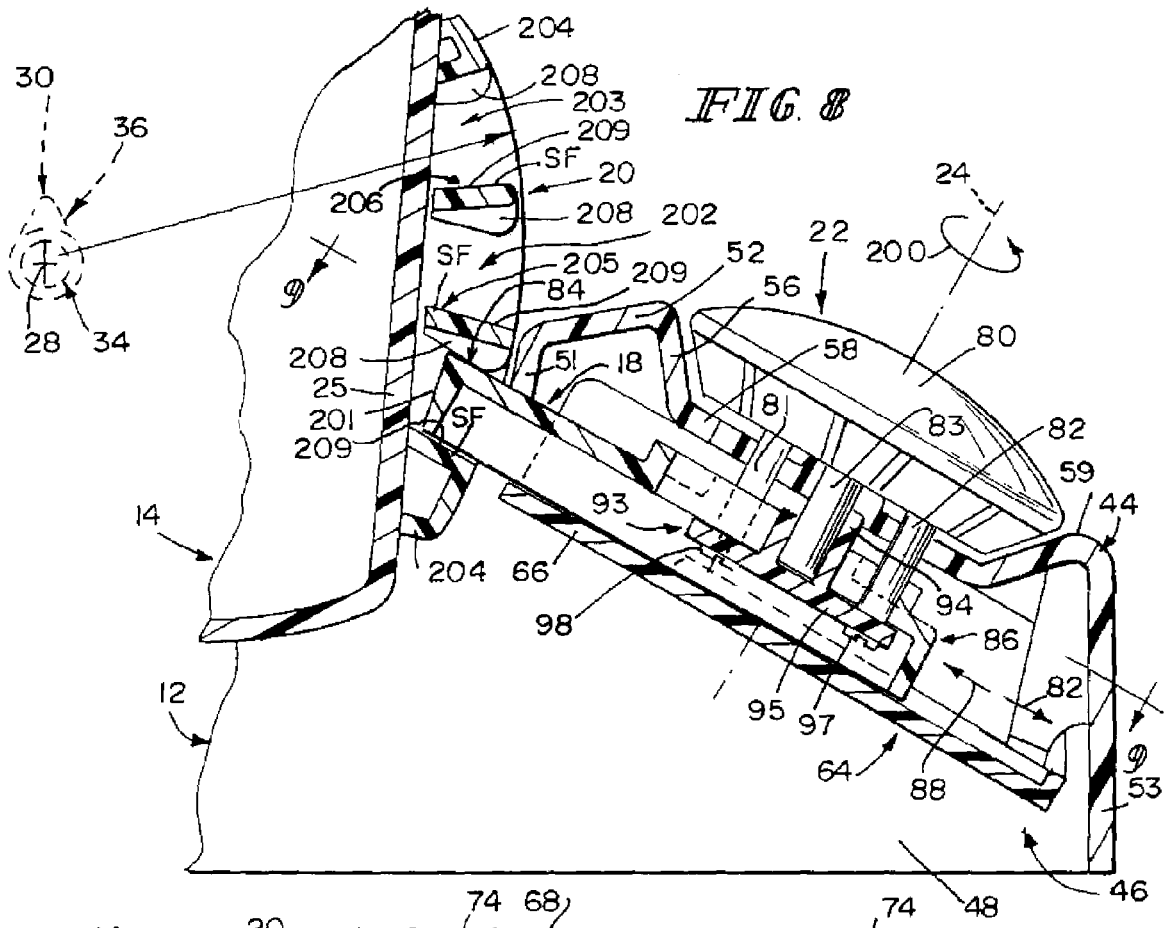
FIG. 8 is a sectional view similar to FIG. 6 showing the backrest retainer after it has been moved to assume an extended position inserting the backrest anchor into the lower anchor slot in response to rotation of the recline adjustor knob in a "counterclockwise" direction about its axis of rotation so that the backrest is retained in its upright orientation relative to the seat base.

Backrest support 44 of seat base 12 is formed to include an interior region 46 containing movable backrest retainer 18 as shown, for example, in FIGS. 5, 6, and 8. In an illustrative embodiment shown in FIG. 5, backrest support 44 includes a right side portion 47 including side interior wall 32, a side exterior wall 48, and a side top wall 49 interconnecting walls 32 and 48. Backrest support 44 also includes a rear portion 50 including a rear interior wall 51 arranged to face toward backrest 14, a rear exterior wall 53 arranged to face away from backrest 14, and a rear top wall 52 arranged to interconnect walls 51 and 53 as shown best in FIG. 5.

Rear top wall 52 of seat base 12 is formed to include knob receiver basin 54 as shown, for example, in FIGS. 5, 6, and 8. A frustoconical side wall 56 and a round floor 58 cooperate to define knob receiver basin 54. Floor 58 has a diameter that is less than the diameter of an adjustor aperture 59 formed in rear top wall 52 opening into knob receiver basin 54. Floor 58 is formed to include a central aperture 63 and companion arcuate first and second channels 61, 62 arranged as if they were "parenthesis" symbols spaced apart from one another to locate central aperture 63 therebetween.

Retainer holder 20 on seat back 25 is formed to include a lower anchor socket 201, a middle anchor socket 202, and an upper anchor socket 203 as shown best in FIGS. 5, 6, and 8. Some of these anchor sockets are shown diagrammatically in FIG. 1. Each of anchor sockets 201, 202, and 203 has a rearwardly facing opening sized to receive a backrest anchor 84 included in movable backrest retainer 18 as suggested in FIGS. 5, 6, and 8.

A perimeter ring 204 included in retainer holder 20 surrounds all three anchor sockets 201, 202, and 203 as shown in FIG. 5. A first divider 205 separates lower and middle anchor sockets 201, 202. A second divider 206 separates middle and upper anchor socket 202, 203. Fasteners 207 are used to fasten perimeter ring 204 to seat back 25 of backrest 14 as shown, for example, in FIG. 5. Several downwardly extending spaced-apart fins 208 are provided in each anchor socket 201, 202, and 203 as suggested, for example, in FIGS. 5, 6, and 8. Fins 208 are configured to mate with backrest anchor 84 to help retain backrest retainer 18 in a locked extended position engaging retainer holder 20 when backrest lock 16 is engaged to lock backrest 14 in a stationary position.

A retainer mount 64 is included in seat base 12 and is adapted to support movable backrest retainer 18 as suggested in FIG. 5. Retainer mount 64 is arranged to lie in a stationary position adjacent to retainer holder 20 and fixed to backrest support 44 during pivoting motion of backrest 14 relative to seat base 12 about pivot axis 28 of backrest 14 as shown, for example, in FIGS. 5-9. In an illustrative embodiment, retainer mount 64 is configured to support and guide backrest retainer 18 for sliding movement toward and away from anchor sockets 101, 102, and 103 provided in retainer holder 20.

Retainer mount 64 includes a floor 66 extending laterally between first and second upstanding side panels 67, 68 as shown, for example, in FIG. 5. Retainer mount 64 also includes spaced-apart first and second guide rails 71, 72 extending along floor 66 from a front rim 70 in a direction toward retainer holder 20. Retainer mount 64 also includes several upwardly extending lower fastener receivers 74 arranged to mate with a companion downwardly extending upper fastener receivers 76 lying in interior region 46 of backrest support 44 and hanging from an underside of rear top wall 52 of backrest support 44 as suggested in FIG. 5. Mount fasteners 78 are used to couple companion lower and upper fastener receivers 74, 76 to one another so that retainer mount 20 is retained in a stationary position adjacent to retainer holder 20 and fixed to backrest support 44 as suggested in FIG. 5.

As suggested in FIG. 6, in an illustrative embodiment, floor 66 of retainer mount 64 is inclined to lie at an acute angle $\propto$ of about 30° with respect to a horizontal reference plane (shown in phantom). Inclined floor 66 extends upwardly to lie in closely confronting relation to retainer holder 20. During pivoting movement of backrest 14 about pivot axis 30, inclined floor 66 will, in turn, lie in substantially coplanar relation with a "socket floor" SF provided on an upper surface of the wall 209 in each of anchor sockets 201, 202, 203 as suggested in FIGS. 6 and 8. For example, when backrest 14 is pivoted to align first anchor socket 201 in registry with inclined floor 66 to allow backrest anchor 84 of backrest retainer 18 to be moved into first anchor socket 201, then socket floor SF of first anchor socket is arranged to lie in substantially coplanar relation with inclined floor 66 as suggested in FIGS. 6 and 8. Similarly, socket floor SF of second anchor socket 202 will be about coplanar with inclined floor 66 when backrest 14 is pivoted to cause backrest anchor 84 to be aligned in registry with second anchor socket 202 and socket floor SF of third anchor socket 203 will be about coplanar with inclined floor 66 when backrest 14 is pivoted to cause backrest anchor to be aligned in registry with third anchor socket 203.

Recline adjustor knob 22 includes a round dome-shaped handgrip 80 and a motion controller coupled to the handgrip and configured to provide three downwardly extending posts 81, 82, and 83. These posts 81, 82, and 83 are arranged to extend downwardly from an underside of handgrip 80 through motion-controller openings 61, 62, and 63 formed in round floor 58 of knob receiver basin 54 to mate with movable backrest retainer 18 as suggested in FIG. 5. In the illustrated embodiment, "retainer-driver" post 81 extends through arcuate first channel 61 in floor 58, "drift-blocker" post 82 extends through arcuate second channel 62 in floor 58, and "center-support" post 83 extends through central aperture 63 in floor 58.

Backrest retainer 18 is the component included in backrest lock 16 that engages retainer holder 20 to "lock" backrest 14 to seat base 12 and disengages retainer holder 20 to "unlock" backrest 14 so that backrest 14 is free to move about pivot axis 18 relative to seat base 12. In the illustrated embodiment, backrest retainer 18 includes a backrest anchor 84 sized to fit in any of anchor sockets 201, 202, and 203 provided in retainer holder 20 on seat back 25. Backrest retainer 18 also includes an anchor support 86 appended to backrest anchor 84 and configured to slide on floor 66 of retainer mount 64 as suggested in FIGS. 5, 6, and 8. Anchor support 86 is able to slide in forward direction 88 toward retainer holder 20 to move backrest anchor 84 into one of anchor sockets 201, 202, and 203 to establish a locked extended position of backrest retainer 18. Anchor support 86 is also able to slide in rearward direction 87 to withdraw backrest anchor 84 from one of anchor sockets 201, 202, or 203 to establish an unlocked retracted position of backrest retainer 18.

In the illustrated embodiment, backrest anchor 84 is wider than it is long and thick and is sized to fit into each of anchor sockets 201, 202, and 203. Each set of downwardly extending fins 208 cooperates with a companion opposing wall 209 to form means in each of anchor sockets 201, 202, and 203 for lightly gripping the backrest anchor 84 inserted therein to help retain the backrest anchor 84 in retainer holder 20 when backrest lock 16 is being used to lock backrest 14 to seat base 12 as shown, for example, in FIG. 8. Each of dividers 205 and 206 and perimeter ring 204 includes a wall 209 opposing a companion set of downwardly extending fins 208 as shown, for example, in FIG. 5.

Anchor support 86 of backrest retainer 18 is a "thin" block formed to include first and second guide channels 91 and 92 on a lower surface thereof as shown in FIG. 5. Guide channels 91, 92 are arranged to lie in spaced-apart relation to one another and located to receive first and second guide rails 71, 72 coupled to floor 66 of retainer mount 20 as suggested in FIGS. 6-9. Rails 71, 72 and channels 91, 92 cooperate to define means for defining the path of sliding movement of backrest retainer 18 in directions 87, 88 on retainer mount 64 to guide movement of backrest anchor 18 into and out of anchor sockets 201, 202, and 203 formed in retainer holder 20 in response to rotation of recline adjustor knob 22 about axis of rotation 24.

Figure 7:
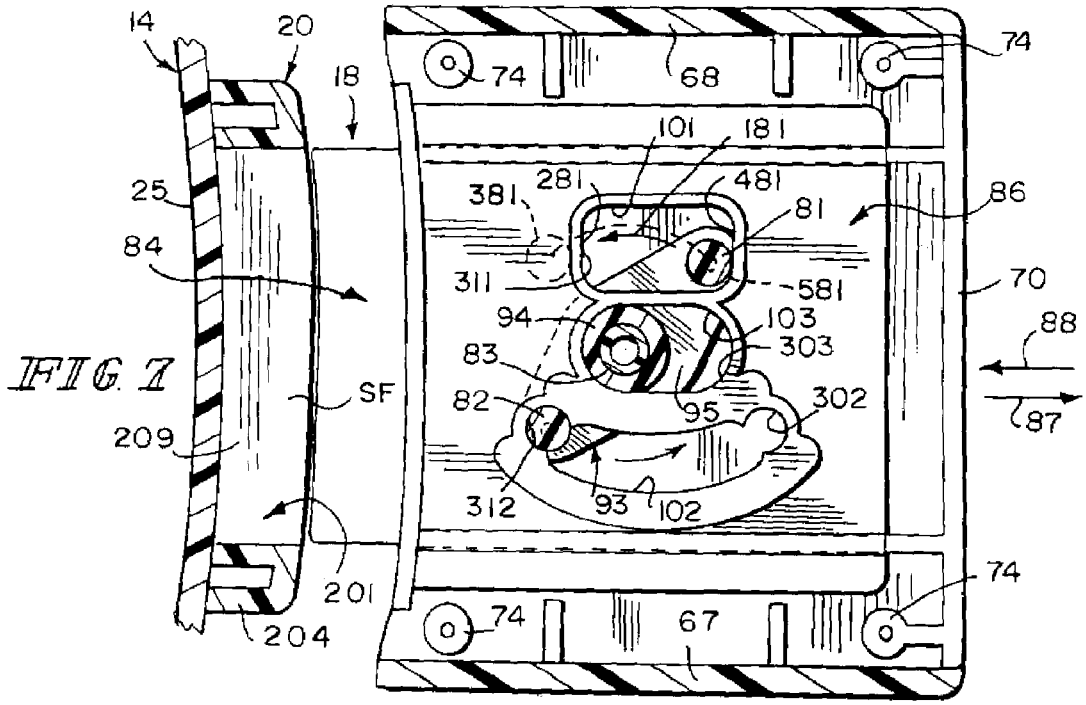
FIG. 7 is a sectional view taken along line 7-7 of FIG. 6 showing the position of three downwardly extending posts included in the recline adjustor knob in "companion" post-transfer channels formed in the backrest retainer when the backrest retainer is in the retracted position shown in FIG. 6.
Figure 7A:
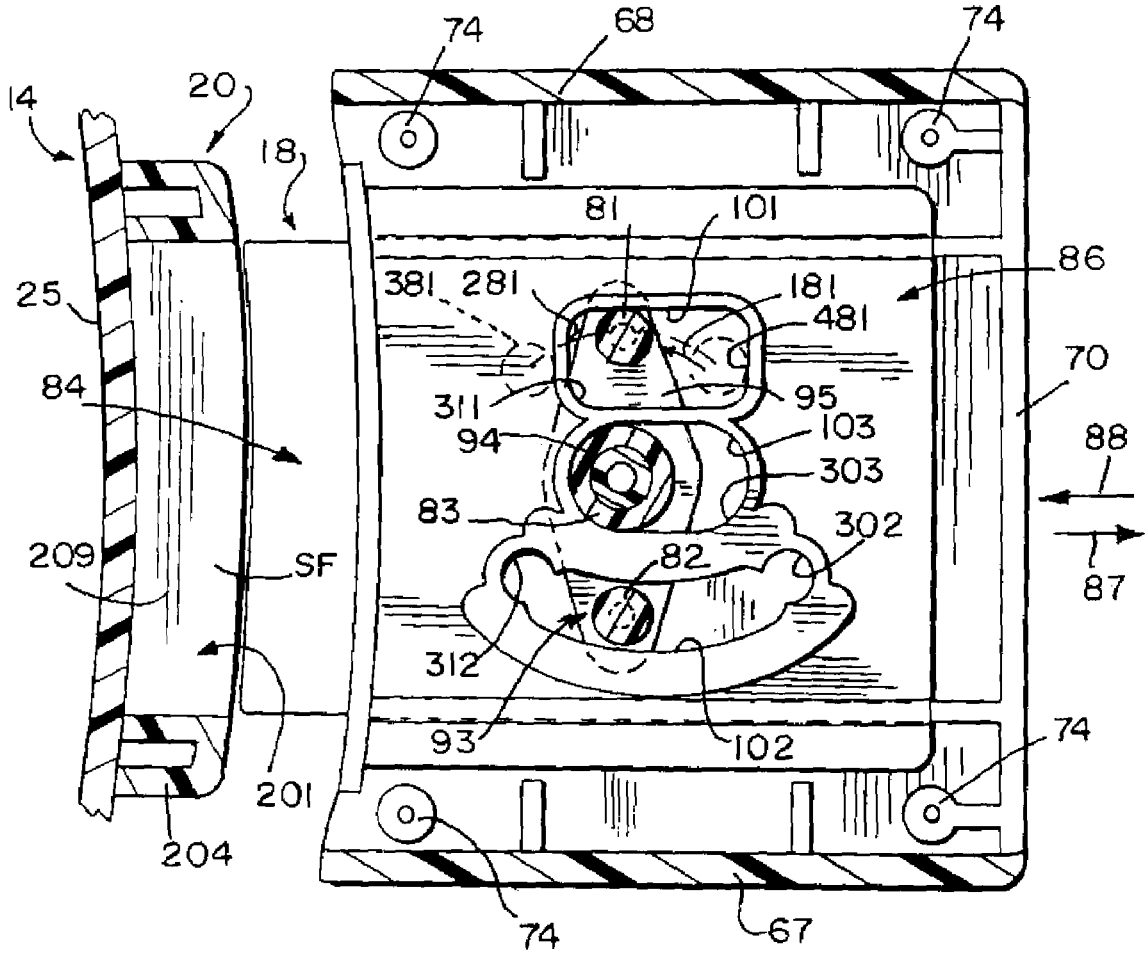
FIG. 7A is a sectional view similar to FIG. 7 showing the position of the three downwardly extending posts during initial rotation of the recline adjustor knob in a clockwise "backrest-locking" direction but before engagement of a retainer-driver post in a rectangle-shaped post-transfer channel with a left side edge of the backrest retainer to begin to cause the backrest retainer to move to the left to assume the backrest-locking position shown in FIG. 9.
Figure 9:
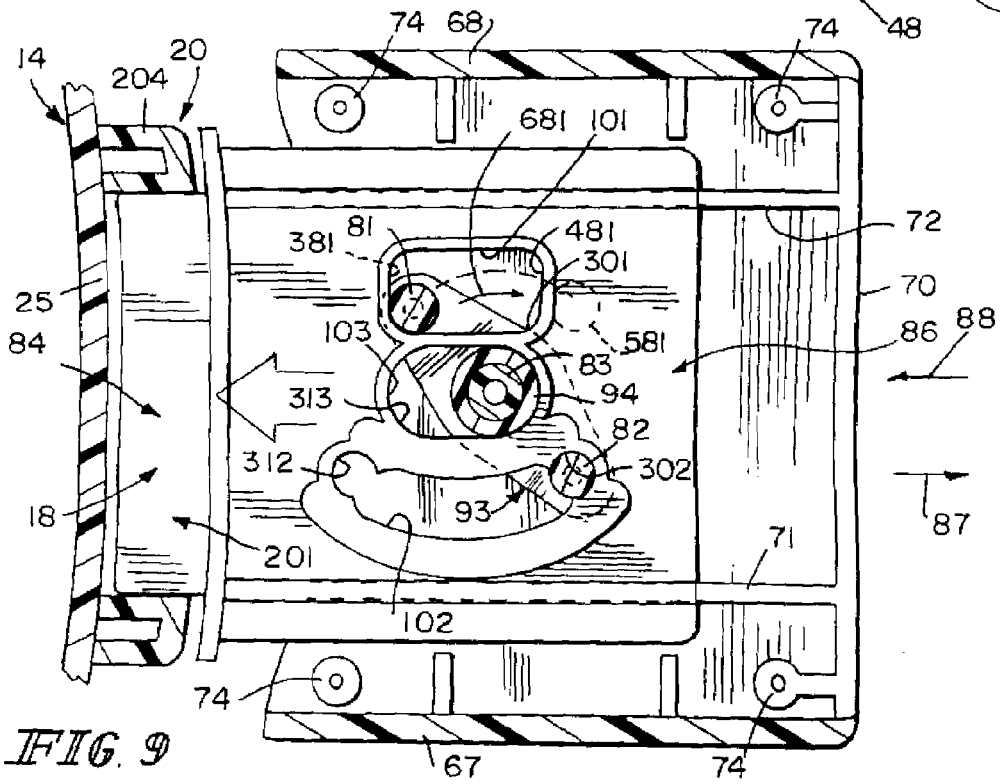
FIG. 9 is a sectional view taken along line 9-9 of FIG. 8 showing a "new" position of each of the three downwardly extending posts included in the recline adjustor knob in the companion post-transfer channels formed in the backrest retainer when the backrest retainer is in the extended position shown in FIG. 8.

Anchor support 86 is formed to include three post-transfer channels 101, 102, and 103 as shown in FIGS. 5, 7, and 9. Each post-transfer channel 101, 102, and 103 is located and sized to receive one of the three downwardly extending posts 81, 82, and 83 included in recline adjustor knob 22. In an illustrative embodiment, as suggested in FIGS. 5, 7, and 9, a "rectangle-shaped" oblong post-transfer channel 101 is configured to receive "retainer-driver" post 81 therein, an arcuate post-transfer channel 102 is configured to receive "drift-blocker" post 82 therein, and an "oval-shaped" oblong post-transfer channel 103 is configured to receive "center-support" post 83 therein.

A knob retainer 93 is provided as suggested in FIG. 5 to retain recline adjustor knob 22 in mating engagement with anchor support 86 of movable backrest retainer 18 as suggested in FIGS. 6-9. Knob retainer 93 includes an upstanding sleeve 94 mounted on a sleeve support plate 95 in the illustrated embodiment. Sleeve 94 is formed to include a central passageway 96 sized to receive center-support post 83 of recline adjustor knob 22 therein as suggested in FIGS. 5-9. In the illustrated embodiment, each end of sleeve support plate 95 is formed to include a fastener receiver aperture 96. A first fastener 97 is provided as suggested in FIGS. 5 and 6 to pass through one of fastener receiver apertures 96 into a downwardly opening bore (not shown) formed in retainer-driver post 81 to fix plate 95 to post 81. A second fastener 98 is provided to pass through the other fastener receiver aperture 76 into a downwardly opening bore (not shown) formed in drift-blocker post 82 to help fix plate 95 to post 82.

Rotation of recline adjustor knob 22 about axis of rotation 24 in a "clockwise" direction 100 moves posts 81, 82, and 83 in companion post-transfer channels 101, 102, and 103 to move backrest retainer 18 on retainer mount 64 in direction 87 away from seat back 25 to a released, retracted, unlocked position disengaging retainer holder 20 as shown, for example, in FIGS. 6 and 7. In contrast, rotation of recline adjustor knob 22 about axis of rotation 24 in a "counterclockwise" direction 200 moves posts 81, 82, and 83 in companion post-transfer channels 101, 102, and 103 to move backrest retainer 18 on retainer mount 64 in direction 88 toward seat back 25 to an engaged, extended, locked position engaging retainer holder 20 as shown, for example, in FIGS. 8 and 9.

As shown in FIGS. 5, 7, and 9, the rectangle-shaped, oblong, retainer-driver, post-transfer channel 101 includes a rearward nest 301 and a forward nest 311 and each nest 301, 302 is sized to receive retainer-driver post 81 therein. Likewise, the oval-shaped, oblong, center-support, post-transfer channel 103 includes a rearward nest 303 and a forward nest 313 and each nest 303, 313 is sized to receive the central post receiver sleeve 94 containing center-support post 83 therein. Furthermore, a rear post retainer 302 is provided at a rear end of arcuate, drift-blocker, post-transfer channel 102 to receive and retain drift-blocker post 82 temporarily when backrest lock 16 is engaged and a front post retainer 312 is provided at a front end of arcuate, drift-blocker, post-transfer channel 102 to receive and retain drift-blocker post 82 temporarily when backrest lock 16 is disengaged.

Backrest retainer 18 is shown in a retracted position on retainer mount 64 in FIG. 7 wherein backrest anchor 84 is withdrawn from lower anchor socket 201 so that a user 53 of juvenile booster seat 10 is free to pivot backrest 14 about axis of rotation 24 to assume any of the upright, first-recline, or second-recline positions shown in FIGS. 2-4. In the retracted position, retainer-driver post 81 is in rearward nest 301, central post-receiver sleeve 94 and center-support post 83 are in forward nest 313, and drift-blocker post 82 is retained temporarily in a "detent" provided by rear post retainer 302.

Backrest retainer 18 is shown in an extended position on retainer mount 64 in FIG. 9 wherein backrest anchor 84 is inserted into lower socket anchor 201 in response to rotation of recline adjustor knob 22 in a counterclockwise direction 200 about its axis of rotation 24 so that backrest 14 is retained in the upright position relative to seat base 12. In the extended position, retainer-driver post 81 is in the forward nest 311, central post-receiver sleeve 94 and center-support post 83 are in forward nest 313, and drift-blocker post 82 is retained in a "detent" provided by front post retainer 312.

Retainer-driver post 81 is located and configured to move along an arcuate path (shown in phantom in FIGS. 7, 74, and 9) in retainer-driver post-transfer channel 101 to cause backrest retainer 18 between the extended and retracted positions in response to rotation of recline adjustor knob 22. When back rest retainer 18 occupies the retracted position shown in FIG. 7, and recline adjustor knob 22 is rotated in counterclockwise direction 200, retainer-driver post 81 will move in direction 181 (along the arcuate path) and engage front wall 281 bordering post-transfer channel 101 to move (i.e., drive) backrest retainer 18 to the left in direction 88 until retainer-driver post 81 "arrives" at position 381 shown in phantom in FIG. 7 (and solid in FIG. 9). At this stage, backrest retainer 18 has been moved (i.e., driven) to assume the extended position shown in FIG. 9. Moreover, drift-blocker post 82 has been moved through post-transfer channel 102 into rear post retainer 302 to cause backrest retainer 18 to remain in the extended position without unwanted "drift" or movement toward the retracted position.

When backrest retainer 18 occupies the extended position shown in FIG. 9, and recline adjustor knob 22 is rotated in clockwise direction 100, retainer-driver post 81 will move in direction 681 (along the arcuate path) and engage rear wall 481 bordering post-transfer channel 101 to move (i.e., drive) backrest retainer 18 to the right in direction 87 until retainer-driver post 81 "arrives" at position 581 shown in phantom in FIG. 9 (and in solid in FIG. 7). At this stage, backrest retainer 18 has been moved (i.e., driven) to assume the retracted position shown in FIG. 7. Moreover, drift-blocker post 82 has been moved through post-transfer channel 102 into front post retainer 312 to cause backrest retainer 18 to remain in the retracted position without unwanted drift or movement toward the extended position.

The invention claimed is:

1. A juvenile seat comprising a seat base, a reclinable backrest mounted for pivotable movement relative to the seat base to change orientation of the reclinable backrest, a backrest lock coupled to the seat base and to the reclinable backrest, the backrest lock including a backrest retainer movably mounted in the seat base, a retainer holder coupled to the reclinable backrest and arranged to move therewith relative to the seat base, and a recline adjustor coupled to the backrest retainer and mounted for movement relative to the seat base in a first direction to move the backrest retainer to an extended position to mate with the retainer holder to lock the reclinable backrest in a selected stationary position relative to the seat base to establish a first orientation and in a second direction to move the backrest retainer to a retracted position to unmate from the retainer holder to release the reclinable seat back for pivotable movement relative to the seat base to assume a second orientation, and wherein the seat base includes a seat bottom adapted to support a seated juvenile thereon and first and second arm supports arranged to lie in spaced-apart relation to one another to locate the seat bottom and the reclinable backrest therebetween, the seat base also includes a backrest support arranged to extend in a rearward direction away from the seat bottom and the backrest, the backrest support is formed to include an interior region containing the backrest retainer, and the recline adjustor includes a handgrip arranged to lie in an exposed position outside of the interior region and a motion controller coupled to the handgrip and arranged to extend through an adjustor aperture formed in the backrest support to mate with the backrest retainer.

2. The juvenile seat of claim 1, wherein the backrest support includes a rear portion including a rear interior wall arranged to face toward the reclinable backrest, a rear exterior wall arranged to face away from the reclinable backrest, and a rear top wall arranged to interconnect the rear interior an exterior walls and formed to include the adjustor aperture.

3. The juvenile seat of claim 1, wherein the backrest support includes a rear top wall formed to include the adjustor aperture and an outwardly opening basin located in the adjustor aperture and coupled to the rear top wall, the basin includes a floor and a side wall arranged to interconnect the floor and the rear top wall, and configured to cooperate with the floor to form a region receiving the handgrip therein, the floor is formed to include an opening, and the motion controller includes a post coupled to the underside of the handgrip and arrange to extend through the opening formed in the floor to mate with the retainer mover.

4. The juvenile seat of claim 1, wherein the retainer holder is formed to include a lower anchor socket and an upper anchor socket, each of the lower and upper anchor sockets has a rearwardly facing opening sized to receive a backrest anchor included in the backrest retainer to lock the reclinable backrest in a selected stationary position in response to movement of the recline adjustor relative to the seat base in the first direction, and the backrest anchor is moved to assume a position outside of the lower and upper anchor sockets in response to movement of the recline adjustor relative to the seat base in the second direction.

5. The juvenile seat of claim 4, wherein the backrest retainer further includes an anchor support coupled to the backrest anchor and formed to include a retainer-driver post-transfer channel and the recline adjustor includes a retainer-driver post mounted for movement in the retainer-driver post-transfer channel in a forward direction toward the retainer holder to move the anchor support toward the retainer holder and the backrest anchor on the anchor support into a selected one of the lower and upper anchor sockets and in a rearward direction away from the retainer holder to move the anchor support away from the retainer holder and the backrest anchor on the anchor support out of the lower and upper anchor sockets.

6. The juvenile seat of claim 5, wherein the recline adjustor further includes a handgrip supported for rotation about an axis of rotation relative to the base and coupled to the retainer-driver post to provide means for moving the retainer-driver post in the retainer-driver post-transfer channel in the forward direction in response to rotation of the handgrip about the axis of rotation in the first direction and in the rearward direction in response to rotation of the handgrip about the axis of rotation in the second direction.

7. The juvenile seat of claim 5, wherein the recline adjustor is coupled to the anchor support to constrain the retainer-driver post to move along an arcuate path in the retainer-driver post-transfer channel during movement of the retainer driver post in the forward and rearward directions.

8. The juvenile seat of claim 7, wherein the retainer-driver post has a first diameter, the retainer-driver post-transfer channel has an oblong shape characterized by a width that is greater than the first diameter and a length that is greater than the first diameter, the retainer drive post-transfer channel has a rearward nest arranged to receive the retainer-driver post upon movement of the backrest retainer to the retracted position and a forward nest located between the backrest anchor and the rearward nest and arranged to receive the retainer-driver post upon movement of the backrest retainer to the extended position, the anchor support includes an interior edge bordering the retainer-driver post-transfer channel, and the retainer-driver post engages the interior edge border while located in the forward and rearward nests and disengages the interior edge border during movement between the forward and rearward nests along the arcuate path in the retainer-driver post-transfer channel.

9. The juvenile seat of claim 5, wherein the anchor support is also formed to include a center-support post-transfer channel and the recline adjustor further includes a center-support post arranged to lie in spaced-apart relation to the retainer-driver post and mounted for movement in the center-support post-transfer channel in the forward direction toward the retainer holder in response to movement of the retainer-driver post in the rearward direction away from the retainer holder and in the rearward direction away from the retainer holder in response to movement of the retainer-driver post in the forward direction toward the retainer holder.

10. The juvenile seat of claim 9, wherein the anchor support is also formed to include a rear post retainer, a front post retainer located between the rear post retainer and the backrest anchor, an arcuate post-transfer channel arranged to interconnect the rear and front post retainers and positioned to lie in spaced-apart relation to the retainer-driver post-transfer channel to locate the center-support post-transfer channel therebetween, the recline adjustor further includes a drift-blocker post arranged to lie in spaced-apart relation to the retainer-driver post to locate the center-support post therebetween, the drift-blocker post is mounted for movement in the arcuate post-transfer channel between the rear and front post retainers in a clockwise direction about an axis established by the center-support post toward the front post retainer in response to movement of the retainer-driver post in the rearward direction and in a counterclockwise direction about the axis established by the center-support post toward the rear post retainer in response to movement of the retainer-driver post in the first direction.

11. The juvenile seat of claim 10, wherein the anchor support further includes first detent means for retaining drift-blocker post temporarily in rear post retainer upon arrival of the drift-blocker post in the rear post retainer until a handgrip included in the recline adjustor and coupled to each of the retainer-driver, center-support, and drift-blocker posts is moved by a caregiver relative to the base to cause the retainer-driver post to move in the rearward direction in the retainer-driver post-transfer channel so that there is no unauthorized drifting movement of the retainer-driver post in the retainer-driver post-transfer channel to cause unauthorized movement of the backrest retainer from the extended position to the retracted position.

12. The juvenile seat of claim 10, wherein the recline adjustor further includes a handgrip coupled to each of the retainer-driver, center-support and drift-blocker posts and supported for rotational movement about an axis of rotation established by the center-support post in a selected one of the first and second directions to control movement of the backrest retainer between the extended and retracted positions.

13. The juvenile seat of claim 4, wherein the backrest lock further includes a retainer mount having a floor arranged to underlie the backrest retainer and configured to support the backrest retainer for back-and-forth sliding movement toward and away from the retainer holder.

14. The juvenile seat of claim 13, wherein the floor is also arranged to lie under the recline adjustor.

15. The juvenile seat of claim 13, wherein the seat base includes a seat bottom adapted to support a seated juvenile thereon and first and second arm supports arranged to lie in spaced-apart relation to one another to locate the seat bottom and the reclinable backrest therebetween, the seat base also includes a backrest support arranged to extend in a rearward direction away from the seat bottom and the backrest, the backrest support is formed to include an interior region containing the backrest retainer, the recline adjustor includes a handgrip arranged to lie in an exposed position outside of the interior region and a motion controller coupled to the handgrip and arranged to extend through an adjustor aperture formed in the backrest support to mate with the backrest retainer, and the floor of the retainer mount is located in the interior region of the backrest support in a position underlying the handgrip and the motion controller.

16. The juvenile seat of claim 13, wherein the retainer holder includes a wall associated with each of the lower and upper anchor sockets, the floor of the retainer mount is inclined to lie at an acute angle relative to a horizontal reference plane and is arranged to extend upwardly to lie in closely confronting relation to the retainer holder, and the inclined floor is arranged to lie in substantially coplanar relation to a first socket floor provided on an upper surface of the wall associated with the lower anchor socket upon pivoting movement of the reclinable backrest to align the first anchor socket in registry with the inclined floor and to assume the first orientation and to a second socket floor provided on an upper surface of the wall associated with the upper anchor socket upon pivoting movement of the reclinable backrest to align the second anchor socket in registry with the inclined floor and to assume the second orientation.

17. The juvenile seat of claim 16, wherein the floor is also arranged to lie under the recline adjustor.

18. The juvenile seat of claim 13, wherein the retainer mount further includes first and second guide rails arranged to lie in spaced-apart relation to one another to locate the floor therebetween, the backrest retainer further includes an anchor support coupled to the backrest anchor and mounted for back-and-forth sliding movement on the floor of the retainer mount, and the anchor support is formed to include a first guide channel receiving the first guide rail therein and a second guide channel receiving the second guide rail therein, and the rails and channels cooperate to define means for defining a path of sliding movement of the anchor support on the floor to guide movement of the backrest anchor into and out of annular sockets formed in the retainer holder in response to movement of the recline adjustor in the first and second directions.

19. The juvenile seat of claim 1, wherein the retainer holder is formed to include a lower anchor socket and an upper anchor socket, each of the lower and upper anchor sockets has a rearwardly facing opening sized to receive a backrest anchor included in the backrest retainer to lock the reclinable backrest in a selected stationary position in response to movement of the recline adjustor relative to the seat base in the first direction, the backrest anchor is moved to assume a position outside of the lower and upper anchor sockets in response to movement of the recline adjustor relative to the seat base in the second direction, each of the lower and upper anchor sockets is bordered by a lower wall and an upper wall overlying the lower wall, the retainer holder further includes a first set of spaced-apart fins coupled to the upper wall of the lower anchor socket and arranged to extend downwardly toward the lower wall of the first annular socket and cooperate with the lower annular wall of the first annular socket to define means in the first annular socket for lightly gripping a backrest anchor inserted therein to help retain the backrest anchor in the first annular socket when the backrest lock is being used to lock the reclinable backrest to the seat base.

20. The juvenile seat of claim 1, wherein the retainer holder is formed to include a lower anchor socket and an upper anchor socket, each of the lower and upper anchor sockets has a rearwardly facing opening sized to receive a backrest anchor included in the backrest retainer to lock the reclinable backrest in a selected stationary position in response to movement of the recline adjustor relative to the seat base in the first direction, the backrest anchor is moved to assume a position outside of the lower and upper anchor sockets in response to movement of the recline adjustor relative to the seat base in the second direction, the recline adjustor includes three downwardly extending posts and a handgrip coupled to the three downwardly extending posts and supported for rotation about an axis to move the three downwardly extending posts relative to the seat base, the backrest retainer further includes an anchor support coupled to the backrest anchor to move therewith relative to the retainer holder, the anchor support is formed to include three post-transfer channels, each post-transfer channel is located and sized to receive one of the three downwardly extending posts included in the recline adjustor, and the three downwardly extending posts are arranged to move in companion post-transfer channels in response to rotation of the handgrip about the axis to move the backrest retainer between the extended and retracted positions.

21. A juvenile seat comprising a seat base, a reclinable backrest mounted for pivotable movement relative to the seat base to change orientation of the reclinable backrest, a backrest lock coupled to the seat base and to the reclinable backrest, the backrest lock including a backrest retainer movably mounted in the seat base, a retainer holder coupled to the reclinable backrest and arranged to move therewith relative to the seat base, and a recline adjustor coupled to the backrest retainer and mounted for movement relative to the seat base in a first direction to move the backrest retainer to an extended position to mate with the retainer holder to lock the reclinable backrest in a selected stationary position relative to the seat base to establish a first orientation and in a second direction to move the backrest retainer to a retracted position to unmate from the retainer holder to release the reclinable seat back for pivotable movement relative to the seat base to assume a second orientation, wherein the seat base includes a seat bottom adapted to support a seated juvenile thereon and first and second arm supports arranged to lie in spaced-apart relation to one another to locate the seat bottom and the reclinable backrest therebetween, the seat base also includes a backrest support arranged to extend in a rearward direction away from the seat bottom and the backrest, the backrest support is formed to include an interior region containing the backrest retainer, and the recline adjustor includes a handgrip arranged to lie in an exposed position outside of the interior region and a motion controller coupled to the handgrip and arranged to extend through an adjustor aperture formed in the backrest support to mate with the backrest retainer; and wherein the retainer holder is formed to include a lower anchor socket and an upper anchor socket, each of the lower and upper anchor sockets has a rearwardly facing opening sized to receive a backrest anchor included in the backrest retainer to lock the reclinable backrest in a selected stationary position in response to movement of the recline adjustor relative to the seat base in the first direction, and the backrest anchor is moved to assume a position outside of the lower and upper anchor sockets in response to movement of the recline adjustor relative to the seat base in the second direction.

22. A juvenile seat comprising a seat base, a reclinable backrest mounted for pivotable movement relative to the seat base to change orientation of the reclinable backrest, a backrest lock coupled to the seat base and to the reclinable backrest, the backrest lock including a backrest retainer movably mounted in the seat base, a retainer holder coupled to the reclinable backrest and arranged to move therewith relative to the seat base, and a recline adjustor coupled to the backrest retainer and mounted for movement relative to the seat base in a first direction to move the backrest retainer to an extended position to mate with the retainer holder to lock the reclinable backrest in a selected stationary position relative to the seat base to establish a first orientation and in a second direction to move the backrest retainer to a retracted position to unmate from the retainer holder to release the reclinable seat back for pivotable movement relative to the seat base to assume a second orientation, wherein the seat base includes a seat bottom adapted to support a seated juvenile thereon and first and second arm supports arranged to lie in spaced-apart relation to one another to locate the seat bottom and the reclinable backrest therebetween, the seat base also includes a backrest support arranged to extend in a rearward direction away from the seat bottom and the backrest, the backrest support is formed to include an interior region containing the backrest retainer, and the recline adjustor includes a handgrip arranged to lie in an exposed position outside of the interior region and a motion controller coupled to the handgrip and arranged to extend through an adjustor aperture formed in the backrest support to mate with the backrest retainer; and wherein the retainer holder is formed to include a lower anchor socket and an upper anchor socket, each of the lower and upper anchor sockets has a rearwardly facing opening sized to receive a backrest anchor included in the backrest retainer to lock the reclinable backrest in a selected stationary position in response to movement of the recline adjustor relative to the seat base in the first direction, the backrest anchor is moved to assume a position outside of the lower and upper anchor sockets in response to movement of the recline adjustor relative to the seat base in the second direction, each of the lower and upper anchor sockets is bordered by a lower wall and an upper wall overlying the lower wall, the retainer holder further includes a first set of spaced-apart fins coupled to the upper wall of the lower anchor socket and arranged to extend downwardly toward the lower wall of the first annular socket and cooperate with the lower annular wall of the first annular socket to define means in the first annular socket for lightly gripping a backrest anchor inserted therein to help retain the backrest anchor in the first annular socket when the backrest lock is being used to lock the reclinable backrest to the seat base.

23. A juvenile seat comprising a seat base, a reclinable backrest mounted for pivotable movement relative to the seat base to change orientation of the reclinable backrest, a backrest lock coupled to the seat base and to the reclinable backrest, the backrest lock including a backrest retainer movably mounted in the seat base, a retainer holder coupled to the reclinable backrest and arranged to move therewith relative to the seat base, and a recline adjustor coupled to the backrest retainer and mounted for movement relative to the seat base in a first direction to move the backrest retainer to an extended position to mate with the retainer holder to lock the reclinable backrest in a selected stationary position relative to the seat base to establish a first orientation and in a second direction to move the backrest retainer to a retracted position to unmate from the retainer holder to release the reclinable seat back for pivotable movement relative to the seat base to assume a second orientation, wherein the seat base includes a seat bottom adapted to support a seated juvenile thereon and first and second arm supports arranged to lie in spaced-apart relation to one another to locate the seat bottom and the reclinable backrest therebetween, the seat base also includes a backrest support arranged to extend in a rearward direction away from the seat bottom and the backrest, the backrest support is formed to include an interior region containing the backrest retainer, and the recline adjustor includes a handgrip arranged to lie in an exposed position outside of the interior region and a motion controller coupled to the handgrip and arranged to extend through an adjustor aperture formed in the backrest support to mate with the backrest retainer; and wherein the retainer holder is formed to include a lower anchor socket and an upper anchor socket, each of the lower and upper anchor sockets has a rearwardly facing opening sized to receive a backrest anchor included in the backrest retainer to lock the reclinable backrest in a selected stationary position in response to movement of the recline adjustor relative to the seat base in the first direction, the backrest anchor is moved to assume a position outside of the lower and upper anchor sockets in response to movement of the recline adjustor relative to the seat base in the second direction, the recline adjustor includes three downwardly extending posts and a handgrip coupled to the three downwardly extending posts and supported for rotation about an axis to move the three downwardly extending posts relative to the seat base, the backrest retainer further includes an anchor support coupled to the backrest anchor to move therewith relative to the retainer holder, the anchor support is formed to include three post-transfer channels, each post-transfer channel is located and sized to receive one of the three downwardly extending posts included in the recline adjustor, and the three downwardly extending posts are arranged to move in companion post-transfer channels in response to rotation of the handgrip about the axis to move the backrest retainer between the extended and retracted positions.

* * * * *